US009440160B1

(12) United States Patent
Isra-El

(10) Patent No.: US 9,440,160 B1
(45) Date of Patent: Sep. 13, 2016

(54) WAVE SIMULATING APPARATUS

(71) Applicant: Roeh Ben Isra-El, Highland, MD (US)

(72) Inventor: Roeh Ben Isra-El, Highland, MD (US)

( * ) Notice: Subject to any disclaimer, the term of this patent is extended or adjusted under 35 U.S.C. 154(b) by 0 days.

(21) Appl. No.: 14/729,116

(22) Filed: Jun. 3, 2015

(51) Int. Cl.
*A63H 3/00* (2006.01)
*A63H 33/22* (2006.01)
*A41D 7/00* (2006.01)

(52) U.S. Cl.
CPC ..... *A63H 33/22* (2013.01)

(58) Field of Classification Search
CPC ..... A63H 3/00; A63H 3/02; A63H 3/003; A63H 3/005; A41D 7/00; A41D 7/12; A41D 27/10; A41D 15/00
USPC ..... 446/26–28; 2/16, 20, 59, 160, 161.1, 2/161.6
See application file for complete search history.

(56) References Cited

U.S. PATENT DOCUMENTS 5,400,437 A 3/1995 Koutras
7,146,648 B1 12/2006 Kessee
7,520,074 B1 4/2009 Vanova
8,726,435 B2 5/2014 Briody
8,864,544 B2 * 10/2014 Anderman ..... A63H 3/003 2/75
2003/0074819 A1 4/2003 Corona
2009/0298378 A1 * 12/2009 Segal ..... A63J 7/005 446/26
2013/0025060 A1 1/2013 Shull et al.
2013/0287971 A1 10/2013 Caldwell
2014/0026286 A1 1/2014 Hendley et al.

* cited by examiner

*Primary Examiner* — Kien Nguyen
(74) *Attorney, Agent, or Firm* — The Law Firm of Andrea Hence Evans, LLC

(57) ABSTRACT

The invention features an event wave simulating apparatus used at an event, concert or performance etc. by spectators, fans, etc. to show their enthusiasm and/or support for the event. Users may express their enthusiasm or support by simulating a wave when the apparatus is waved. The apparatus includes a first section which is connected with a second section which includes a closed enclosure. The apparatus also includes two sleeves within the first section, where each sleeve is configured to receive a user's arms and where the sleeves extend into the first section.

14 Claims, 1 Drawing Sheet

WAVE SIMULATING APPARATUS

FIELD OF THE INVENTION

The present invention relates, in general, to a wave simulating apparatus or device used to simulate a wave effect at events, concerts, performances, etc.

BACKGROUND OF THE INVENTION

Fans, spectators, enthusiasts etc. that attend events tend to show their enthusiasm and/or support for the events, concerts, performances, etc. by participating in a number of activities during the event or performance. In some instances, fans show their support for their teams, performers by waving flags symbolizing their team, favorite performer etc. In other instances, fans participate in almost choreographed "human wave" simulations where they rise up from their seats in sequence thereby appearing as a "wave" when viewed from afar. However, fans, spectators, enthusiasts etc. still seek for more ways to show their enthusiasm for events beyond human wave simulations.

SUMMARY OF THE INVENTION

In light of the ever present need for ways to expression one's enthusiasm and/or support for an event, concert, performance, etc. the present invention provides a wave simulating apparatus that enables enthusiastic fans or spectators to express their support at sporting events, concerts, performances, etc.

An aspect of an embodiment of the present invention contemplates an event wave simulating apparatus which may include: a first section connected with a second section at a connection region, where the second section may include a closed enclosure, and two sleeves within the first section, where each sleeve may be configured to receive a user's arms and where the sleeves extend into the first section.

Another aspect of an embodiment of the present invention contemplates an event wave simulating apparatus which may include: a first section connected with a second section at a connection region, where the second section may include a closed enclosure, and two sleeves within the first section, where each sleeve may be configured to receive appendages that may be held by a user when waving the event wave simulating apparatus and where the sleeves extend into the first section.

In an aspect of an embodiment of the present invention, the sleeves may be located on opposite ends of the first section.

In an aspect of an embodiment of the present invention, the sleeves may be located opposite each other within the first section.

In an aspect of an embodiment of the present invention, the apparatus may be made of cloth. Another aspect contemplates flexible material other than just cloth. In one instance, the material may include any one of nylon, polyester or the like.

In an aspect of an embodiment of the present invention, each sleeve may extend towards the connection region between the first and second sections In an aspect of an embodiment of the present invention, each sleeve may extend up to the connection region.

In an aspect of an embodiment of the present invention, each sleeve may begin with an opening at the end of the first section opposite the connection region between the first and second sections.

Additional aspects, objectives, features and advantages of the present invention will become apparent from the following description of the preferred embodiments with reference to the attached drawings.

DETAILED DESCRIPTION OF THE INVENTION

Figure 1:
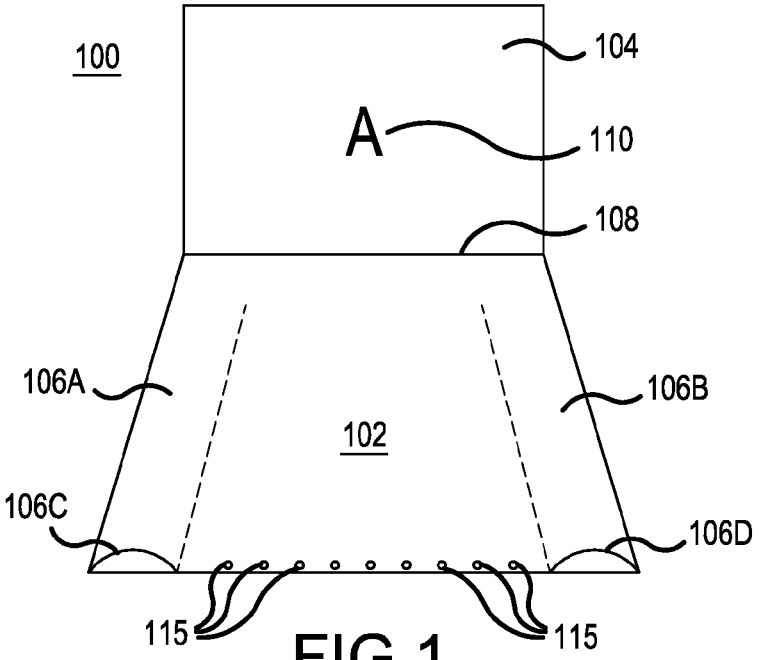
FIG. 1 illustrates an exemplary wave simulating apparatus according to an aspect of an embodiment of the present invention.

Referring now to FIG. 1 a wave simulating apparatus 100 is shown. Wave simulating apparatus 100 may include, as shown, a first section 102 and a second section 104 forming a first sheet. First section 102 may include two sleeves 106A and 106B which extend into first section 102. In one aspect of an embodiment of the present invention, apparatus 100 may be closed in the middle area whereby one's arms are limited in the extent to which they may extend into first section 102.

First section 102 may be connected with second section 104 at/or by connection region 108. In one aspect of an embodiment of the present invention, connection region 108 may include any one of, or different methods of, connecting first section 102 with second section 104 which may include, without limitation, and by way of example only, stitches, buttons, zippers etc. In one aspect of an embodiment of the present invention, sleeves 106A and 106B may have openings 106C and 106D respectively. These openings may be located at the end of first section 102 which is opposite connection region 108. The device openings 106C and 106D are openings along the bottom edge of the device and extend substantially towards the center of the apparatus along the left and right edges of the apparatus. The sleeves are parallel to each other. The sleeves are closed on the opposite ends of the openings so that the users appendages, for example, can extend to a preselected distance along the edge of the apparatus. In another aspect of an embodiment of the present invention, sleeves 106A & 106B may be sized or configured to receive the arms of a user or rods and the like to be used to hold the device. When the user places his/her arms into sleeves 106A & 106B, the user may then lift first section 102 to wave second section 104 to effect the wave simulation. In one aspect of an embodiment of the present invention, the logo, design, form of personalization, message etc. 110 may be placed, printed and/or emblazoned on the front side and/or back of second section 104. In one aspect of an embodiment of the present invention, a user can raise and lower their arms to simulate the wave effect at the event, concert, performance etc. In another aspect of an embodiment of the present invention, apparatus 100 may be made of flowing material, such as material that would enable the wave simulation.

Figure 2:
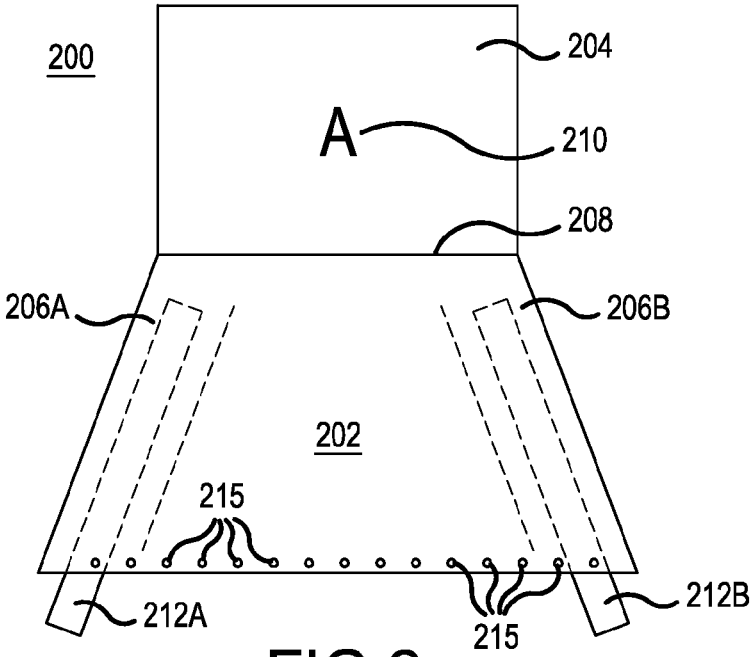
FIG. 2 illustrates an exemplary wave simulating apparatus according to another aspect of an embodiment of the present invention.

Referring now to FIG. 2 a wave simulating apparatus 200 is shown. Wave simulating apparatus 200 may include, as shown, a first section 202 and a second section 204. First section 202 may include two sleeves 206A and 206B which extend into first section 202. In one aspect of an embodiment of the present invention, apparatus 200 may be closed in the middle area whereby one's arms are limited in the extent to which they may extend into first section 202.

First section 202 may be connected with second section 204 by connection region 208. In one aspect of an embodiment of the present invention, connection region 208 may include any one of, or different methods of, connecting first section 202 with second section 204 which may include, without limitation and by way of example only, stitches, buttons, zippers etc.

In another aspect of an embodiment of the present invention, sleeves 206A & B may be sized or configured to receive appendages 212A and 212B. To simulate a wave, a user would hold the ends of appendages 212A and 212B and then lift first section 202 to wave second section 204 to effect the wave simulation. In one aspect of an embodiment of the present invention, the logo, design, form of personalization, message etc. 210 may be placed, printed and/or emblazoned on the front side and/or back of second section 204. Appendages 212A and 212B may be made of any rigid material such as wood, plastic etc.

In one aspect of an embodiment of the present invention, a user can raise and lower their arms to simulate the wave effect at the event, concert, performance etc. In another aspect of an embodiment of the present invention, apparatus 200 may be made of flowing material, such as material that would enable the wave simulation. Another aspect of an embodiment of the present invention, contemplates apparatus 200 being made of flexible material. A further aspect of an embodiment of the present invention, contemplates apparatus 100, 200 being made of a combination of materials whether flexible and/or flowing etc., the combination of which enables the wave simulation.

The material can also feature reflective, glow in the dark and lighted areas. These areas add an additional effect as the wave is simulated.

The invention has been described in detail with particular reference to certain preferred embodiments thereof, but it will be understood that variations and modifications can be effected within the spirit and scope of the invention.

What is claimed is:

1. An event wave simulating apparatus comprising:

a first section connected with a second section at a connection region, two sleeves within the first section, wherein each sleeve is configured to receive a user's arms and wherein the sleeves extend into the first section;

wherein each sleeve begins with an opening at the end of the first section opposite the connection region between the first and second sections.

2. The event wave simulating apparatus of claim 1, wherein the sleeves are located on opposite ends of the first section.

3. The event wave simulating apparatus of claim 1, wherein the sleeves are located opposite each other within the first section.

4. The event wave simulating apparatus of claim 1, wherein the apparatus is made of any one of: flexible or flowing material.

5. The event wave simulating apparatus of claim 1, wherein each sleeve extends towards the connection region between the first and second sections.

6. The event wave simulating apparatus of claim 1, wherein each sleeve extends up to the connection region.

7. The event wave simulating apparatus of claim 1, wherein the apparatus only permits a user's arm to extend into first section a certain distance.

8. An event wave simulating apparatus comprising:

a first section connected with a second section at a connection region, two sleeves within the first section, wherein each sleeve is configured to receive appendages that may be held by a user when waving the event wave simulating apparatus and wherein the sleeves extend into the first section;

wherein each sleeve begins with an opening at the end of the first section opposite the connection region between the first and second sections.

9. The event wave simulating apparatus of claim 8, wherein the sleeves are located on opposite ends of the first section.

10. The event wave simulating apparatus of claim 8, wherein the sleeves are located opposite each other within the first section.

11. The event wave simulating apparatus of claim 8, wherein the apparatus is made of any one of: flexible or flowing material.

12. The event wave stimulating apparatus of claim 8, wherein each sleeve extends towards the connection region between the first and second sections.

13. The event wave stimulating apparatus of claim 8, wherein each sleeve extends up to the connection region.

14. The event wave simulating apparatus of claim 8, wherein the apparatus only permits a user's arm to extend into first section a certain distance.

* * * * *